US010711989B2

(12) United States Patent
Ishizawa et al.

(10) Patent No.: US 10,711,989 B2
(45) Date of Patent: Jul. 14, 2020

(54) FLOODLIGHT

(71) Applicant: LIGHTBOY CO., LTD., Tokyo (JP)

(72) Inventors: Hirotoshi Ishizawa, Tokyo (JP); Atsushi Onishi, Tokyo (JP); Taichi Onodera, Tokyo (JP)

(73) Assignee: LIGHTBOY CO., LTD., Tokyo (JP)

( * ) Notice: Subject to any disclaimer, the term of this patent is extended or adjusted under 35 U.S.C. 154(b) by 0 days.

(21) Appl. No.: 16/073,851

(22) PCT Filed: Jan. 31, 2017

(86) PCT No.: PCT/JP2017/003428
§ 371 (c)(1),
(2) Date: Jul. 30, 2018

(87) PCT Pub. No.: WO2017/135253
PCT Pub. Date: Aug. 10, 2017

(65) Prior Publication Data

US 2019/0041049 A1 Feb. 7, 2019

(30) Foreign Application Priority Data

Feb. 1, 2016 (JP) ..... 2016-029342

(51) Int. Cl.
*F21S 6/00* (2006.01)
*F21V 23/02* (2006.01)
(Continued)

(52) U.S. Cl.
CPC ..... *F21V 29/503* (2015.01); *F21S 2/00* (2013.01); *F21S 6/006* (2013.01); *F21V 29/67* (2015.01);
(Continued)

(58) Field of Classification Search
CPC ..... F21V 29/503; F21V 29/508; F21V 29/67; F21V 29/777; F21V 29/83; F21V 23/02; F21V 31/005; F21S 6/006
See application file for complete search history.

(56) References Cited

U.S. PATENT DOCUMENTS 5,019,880 A * 5/1991 Higgins, III ..... H01L 23/467 165/80.3
5,458,505 A * 10/1995 Prager ..... F21V 19/006 439/485
(Continued)

FOREIGN PATENT DOCUMENTS

JP H10-154889 A 6/1998
JP 2012-243525 A 12/2012
(Continued)

OTHER PUBLICATIONS

May 9, 2017, International Search Opinion issued for related PCT application No. PCT/JP2017/003428.
(Continued)

*Primary Examiner* — Arman B Fallahkhair
(74) *Attorney, Agent, or Firm* — Paratus Law Group, PLLC

(57) ABSTRACT

An object is to provide an LED floodlight that enables efficient use of a cooling means, e.g., a heat dissipation fan, and can pursue a reduction in size. Therefore, it is an LED floodlight wherein a panel-shaped floodlight portion formed as a floodlight surface is formed such that a plurality of LEDs is arranged on a front surface, a heatsink having a plurality of heat dissipation plates on a back surface of the panel-shaped floodlight portion, and a cooling fan configured to send air toward a central portion of the heatsink are arranged in this order, the LED floodlight is formed of an appropriate power supply circuit, wherein a plurality of heat dissipation plates of a heatsink is radially arranged from a
(Continued)

central portion to a periphery, a central portion of a coupling surface between heat dissipation plates of the heatsink protrudes toward a cooling fan configured to send air and has a curved surface portion from a central portion to a periphery.

4 Claims, 6 Drawing Sheets

(51) Int. Cl.

| | |
|---|---|
| ***F21V 29/503*** | (2015.01) |
| ***F21V 29/67*** | (2015.01) |
| ***F21V 29/83*** | (2015.01) |
| ***F21V 29/77*** | (2015.01) |
| ***F21S 2/00*** | (2016.01) |
| *F21V 29/508* | (2015.01) |
| *F21W 131/407* | (2006.01) |
| *F21W 131/105* | (2006.01) |
| *F21Y 105/10* | (2016.01) |
| *F21S 8/08* | (2006.01) |
| *F21W 131/10* | (2006.01) |
| *F21Y 115/10* | (2016.01) |
| *F21V 31/00* | (2006.01) |

(52) U.S. Cl.
CPC ..... *F21V 29/677* (2015.01); *F21V 29/77* (2015.01); *F21V 29/773* (2015.01); *F21V 29/777* (2015.01); *F21V 29/83* (2015.01); *F21S 8/085* (2013.01); *F21V 23/02* (2013.01); *F21V 29/508* (2015.01); *F21V 31/005* (2013.01); *F21W 2131/1005* (2013.01); *F21W 2131/105* (2013.01); *F21W 2131/407* (2013.01); *F21Y 2105/10* (2016.08); *F21Y 2115/10* (2016.08)

(56) References Cited

U.S. PATENT DOCUMENTS

| | | | | |
|---|---|---|---|---|
| 8,057,071 | B2 * | 11/2011 | He | F21K 9/233 362/234 |
| 8,115,395 | B2 * | 2/2012 | Horng | F21V 29/02 315/117 |
| 8,427,059 | B2 * | 4/2013 | Betsuda | F21V 29/02 313/318.01 |
| 8,430,528 | B2 * | 4/2013 | Yu | F21V 29/507 362/249.02 |
| 8,444,299 | B2 * | 5/2013 | Chou | F21V 29/004 165/80.3 |
| 8,480,269 | B2 * | 7/2013 | Horng | F21S 8/02 362/294 |
| 8,529,099 | B2 * | 9/2013 | Yang | F21V 33/0096 362/294 |
| 8,562,179 | B2 * | 10/2013 | Li | F21V 29/02 313/46 |
| 8,764,249 | B2 * | 7/2014 | Toda | F21V 23/006 313/318.01 |
| 8,939,617 | B2 * | 1/2015 | Kim | F21V 29/77 362/373 |
| 9,476,581 | B2 * | 10/2016 | Wu | F21V 31/005 |
| 9,714,762 | B2 * | 7/2017 | Wu | F21S 8/00 |
| 9,964,266 | B2 * | 5/2018 | Danesh | F21S 8/02 |
| 2012/0033419 | A1 * | 2/2012 | Kim | F21S 8/026 362/235 |
| 2014/0307441 | A1 | 10/2014 | Wu | |
| 2016/0348861 | A1 * | 12/2016 | Bailey | F21S 8/026 |

FOREIGN PATENT DOCUMENTS

| | | | |
|---|---|---|---|
| JP | 2014-154434 | A | 8/2014 |
| JP | 2015-220227 | A | 12/2015 |
| JP | 2016-012516 | A | 1/2016 |

OTHER PUBLICATIONS

May 9, 2017, International Search Report issued for related PCT application No. PCT/JP2017/003428.

* cited by examiner

FLOODLIGHT

CROSS REFERENCE TO PRIOR APPLICATION

This application is a National Stage Patent Application of PCT International Patent Application No. PCT/JP2017/003428 (filed on Jan. 31, 2017) under 35 U.S.C. § 371, which claims priority to Japanese Patent Application No. 2016-029342 (filed on Feb. 1, 2016), which are all hereby incorporated by reference in their entirety.

TECHNICAL FIELD

The present invention pertains to an LED floodlight in which a large number of LEDs is arranged as a light-emitting means and relates to an LED floodlight with a heat dissipation structure that efficiently reduces heat generation of the LEDs and a power supply portion.

BACKGROUND ART

Because of characteristics, increased light emitting performance and low power consumption, lighting equipment using an LED as a light-emitting device has been put into practical use. Lighting equipment using an LED including those with a variety of outputs, shapes, and sizes, for example, a light at a construction site, a light at a public facility or sports stadium, and a floodlight for indoor use, in which one or more LEDs are sealed in a mounting case (lighting instrument), has been put into practical use.

An LED floodlight 1 or the like is mounted on an LED floodlight device with a high-power battery device 22 as illustrated, for example, in FIGS. 5 to 7 and is used by being placed in an appropriate location at a construction site, a public facility, or the like.

As illustrated in FIG. 7, the LED floodlight device including the LED floodlight 1 usually moves with a telescopic post 23 being contracted. The LED floodlight device is often used with the post being extended (see FIGS. 5 and 6) in use (for example, the telescopic post 23 is extended to a height of about 5 m). An LED floodlight 1 is focused on a compact design in terms of both weight and volume.

In addition, examples of a drive power supply for lighting thereof include those housed in a common lighting instrument together with the LED and those configured as a separate component with respect to the lighting instrument body as a separate unit (power supply circuit) with respect to the lighting instrument of the LED.

Incidentally, an LED requiring a large amount of light is configured to be a floodlight device with a large amount of light as a whole such that LEDs are arranged lengthwise and crosswise. An LED floodlight for use in such a floodlight device has a larger number of LEDs mounted on one LED floodlight than LED lighting equipment used indoors or the like. When a large number thereof is arranged as a floodlight device, the resulting amount of heat generation is enormous.

An LED is current-driven, and the electric power that does not contribute to light emission becomes heat, which remains in the lighting instrument. In the case of a floodlight device in which a plurality of LED floodlights is arranged, it is difficult to obtain a sufficient heat dissipation effect with a usual heatsink, e.g., a heat dissipation fin, provided one each LED floodlight.

Those disclosing a conventional technique relating to a structure for treating (dissipating) generated heat of the aforementioned LED and power supply circuit of such an LED floodlight include Patent Literature 1 and Patent Literature 2.

An LED lighting device disclosed in Patent Literature 1 is disclosed to be configured to include a panel-shaped floodlight portion in which a front surface is a floodlight portion formed of an LED and a floodlight portion heat dissipation portion that is provided on the back surface of the panel-shaped floodlight portion and dissipates the heat transferred from the LED through stack effect.

In addition, in Patent Literature 2, an LED is arranged at the end of an axial D side of a cylindrical portion of an enclosure on which the LED is mounted, and, in this enclosure, a fan is arranged between an outlet-side punched portion and an inlet-side punched portion. Disclosed is a configuration in which, when the LED is driven, the fan is driven, so that air flowing through the inlet-side punched portion cools the LED and is discharged through the outlet-side punched portion.

Patent Literature 1: JP 2016-12516 A
Patent Literature 2: JP 2014-154434 A

SUMMARY OF THE INVENTION

Problems to be Solved by the Invention

The technique disclosed in Patent Literature 1 is provided on the back surface of the panel-shaped floodlight portion and enables efficient dissipation of the heat transferred from the LED through stack effect. The technique uses a temperature-induced ascending air that moves upward from below. The effect varies with location where the floodlight is used. In addition, a reduction in size is difficult.

In addition, the heat dissipation structure indicated in Patent Literature 2 uses a cooling fan. When the LED is driven, the cooling fan is driven, so that the air flowing through the inlet-side punched portion cools the LED and is discharged through the outlet-side punched portion. However, an aluminum substrate on which the LED is mounted is not cooled sufficiently, and the efficiency is not good.

As described above, the application of the conventional heat dissipation structure of LED lighting equipment as it is to a large-sized (a large light amount) floodlight is not realistic in consideration of the manufacturing cost of the equipment and the accessory costs required for placement of a completed floodlight. It is an object of the present invention to provide an LED floodlight that enables efficient use of a cooling means, e.g., a cooling fan, and can pursue a reduction in size.

Solutions to Problems

In order to achieve the aforementioned object, the LED floodlight according to the present invention is configured in the manner described below. Herein, for the sake of easy understanding of the configuration of the present invention, reference numerals in the drawings of an example are noted in the description.

As illustrated in FIG. 1, the LED floodlight 1 of the present invention is configured such that a panel-shaped floodlight portion 2 formed as a floodlight surface is formed such that LEDs L are arranged on a front surface, a heatsink 3 having heat dissipation plates 7 on the back surface of the panel-shaped floodlight portion 2, and furthermore a cooling fan 4 for sending air to a central portion of the heatsink 3 are arranged in this order, and a power supply circuit 5 is provided such that the power supply circuit is placed on the back surface side or outside of the panel-shaped floodlight portion 2. Furthermore, the heat dissipation plates 7 of the heatsink 3 are radially arranged from a central portion to the periphery. A central portion of a coupling portion 8 between the heat dissipation plates 7 of the heatsink 3 is configured to protrude toward the cooling fan that sends air, and have a curved surface portion 9 from a central portion to the periphery.

Furthermore, according to claim 2, the panel-shaped floodlight portion 2 is closed by being covered with a transparent cover 2*a* on a front surface side, which is the floodlight surface, and includes an air adjustment tube 10 extending through the heatsink 3 from the floodlight surface.

In an ideal example, the air adjustment tube 10 includes a water shut-off valve 11 that prevents water entry.

In addition, according to claim 4, on the side of the heatsink 3, a first cover member 12 is provided, and furthermore the first cover member 12 is configured to include an air intake hole 15 for the cooling fan 4 at a central portion so that the cooling fan 4 is mounted.

According to claim 5, the power supply circuit 5 is mounted on a plate-shaped member and is configured to be a power supply plate 6. Furthermore, the power supply plate 6 includes an air passage hole 16 for the cooling fan 4 at a central portion, and is interposed and fixed between the heatsink 3 and the first cover member 12.

In an ideal example, the first cover member 12 is provided with a second cover member 13 for covering a central portion of the first cover member 12 at a distance that forms an air intake passage.

Effects of the Invention

According to the present invention, particularly, the plurality of heat dissipation plates 7 of the heatsink 3 is radially arranged from a central portion to the periphery, and a central portion of the coupling portion 8 between the heat dissipation plates 7 is configured to protrude toward the cooling fan that sends air and have the curved surface portion 9 from a central portion to the periphery. Therefore, the heatsink can be closely attached to the cooling fan so that the LED floodlight can be configured to be compact as a whole and the cooling effect can be increased, enabling an increase in output of the LED floodlight with ease.

DESCRIPTION OF EMBODIMENTS

Figure 3:
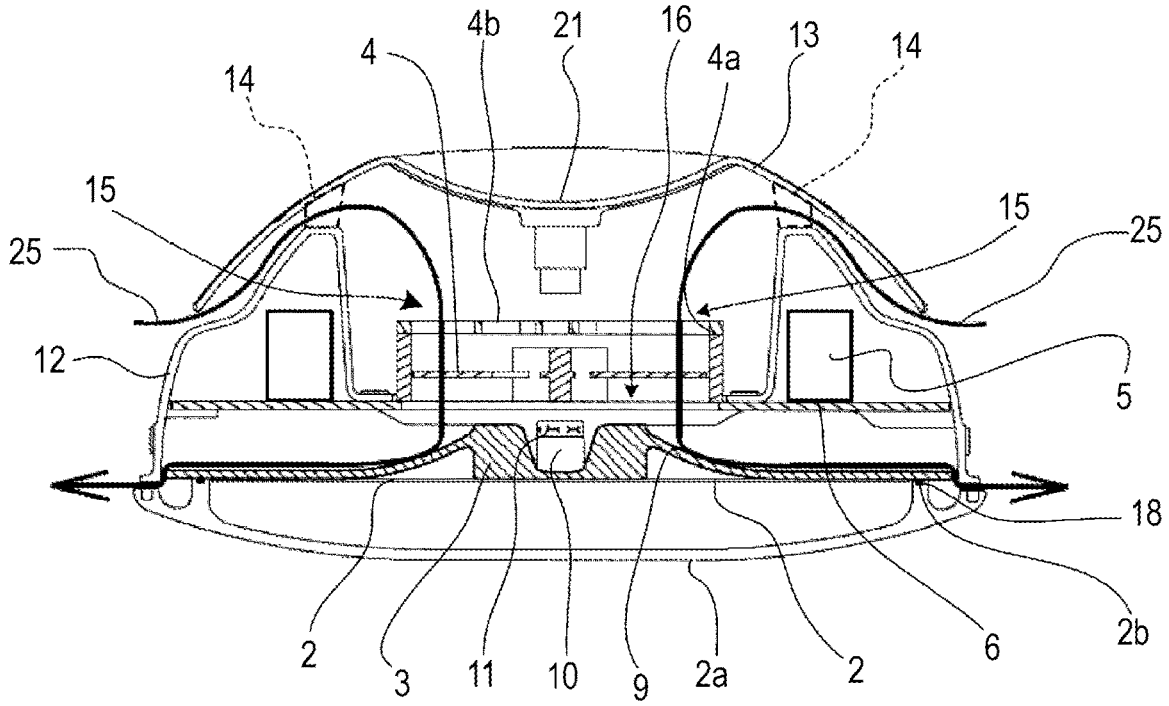
FIG. 3 is an explanatory cross-sectional view of the LED floodlight of the present invention.
Figure 4:
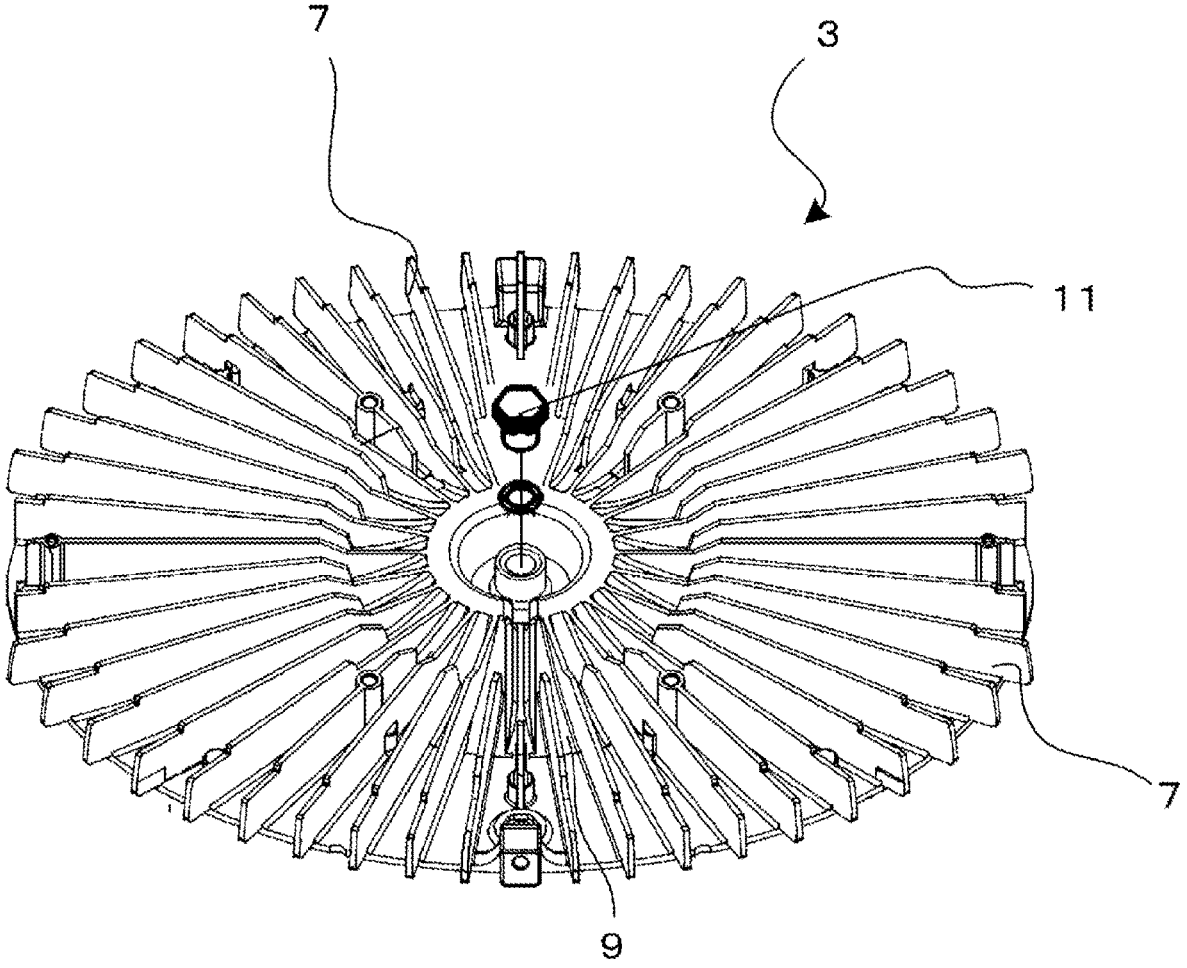
FIG. 4 is an explanatory perspective view of a heatsink of the LED floodlight of the present invention.
Figure 5:
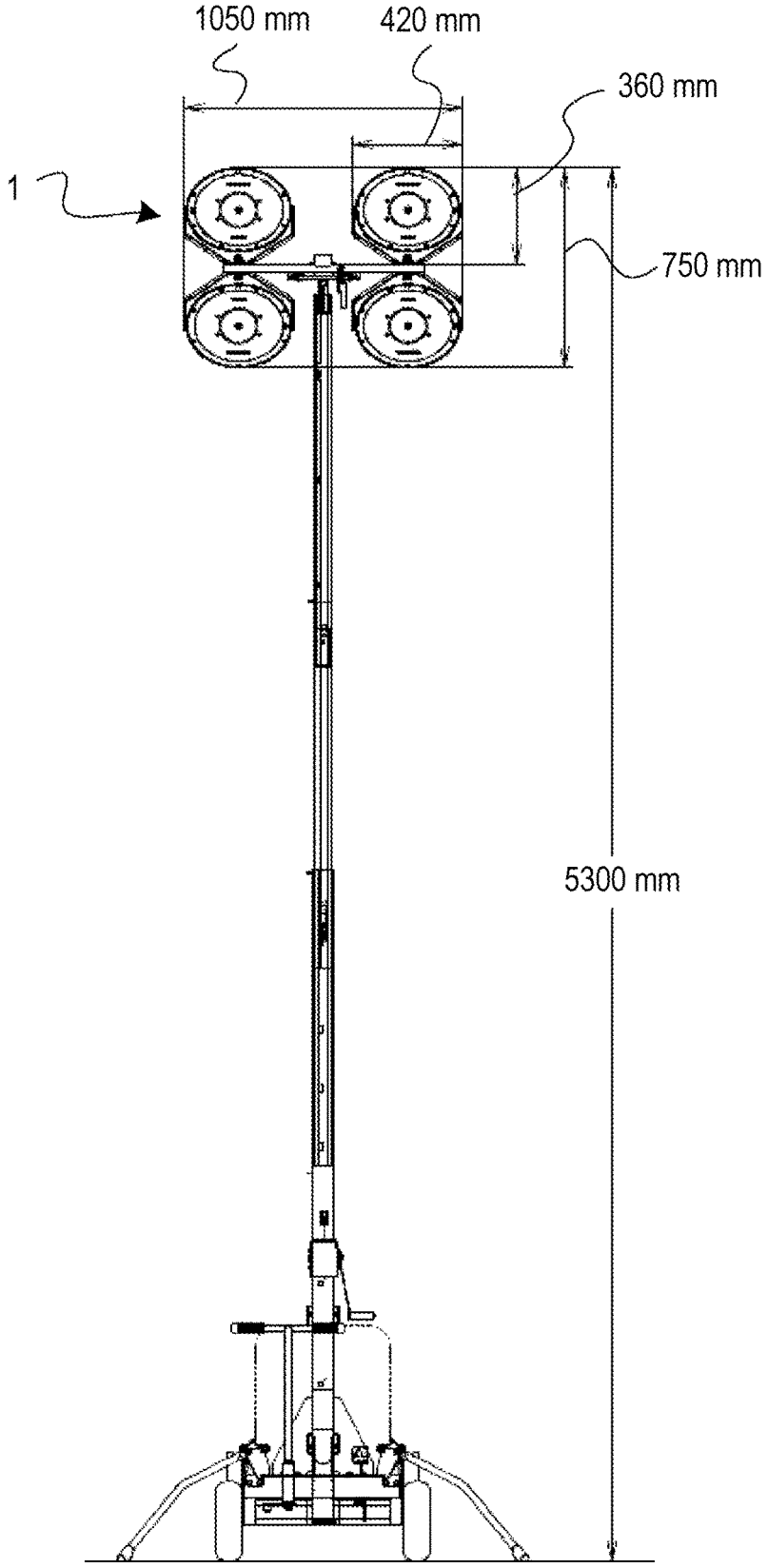
FIG. 5 is an explanatory front view illustrating an example of use of an LED floodlight device provided with the LED floodlight of the present invention.
Figure 6:
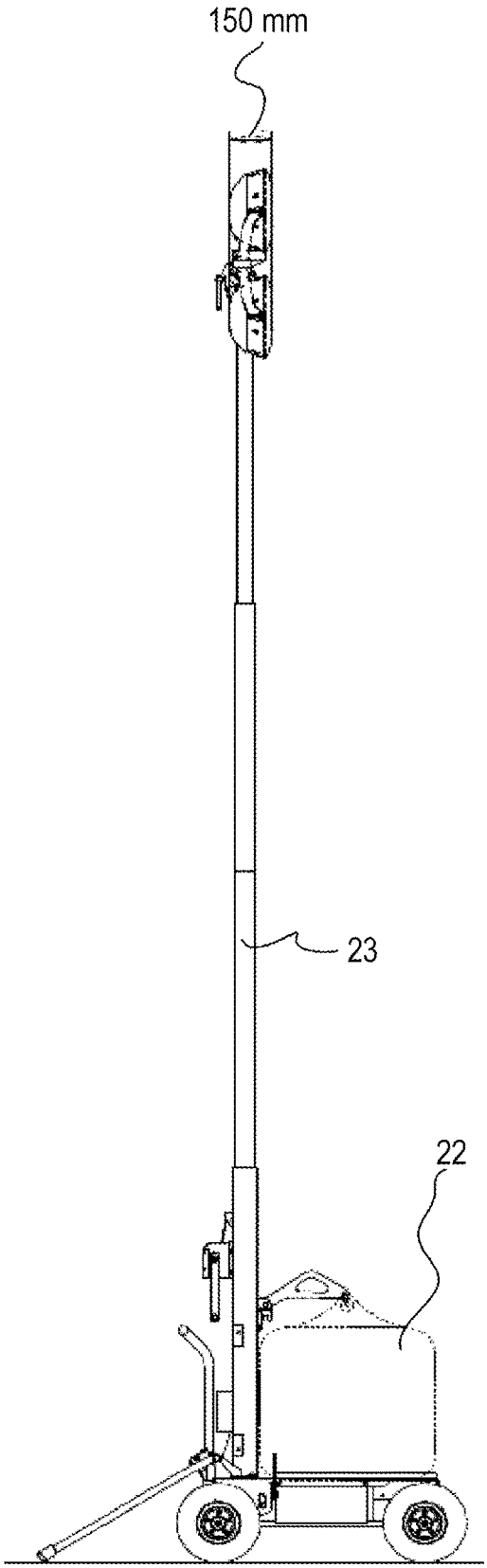
FIG. 6 is an explanatory side view illustrating an example of use of the LED floodlight device provided with the LED floodlight of the present invention.
Figure 7:
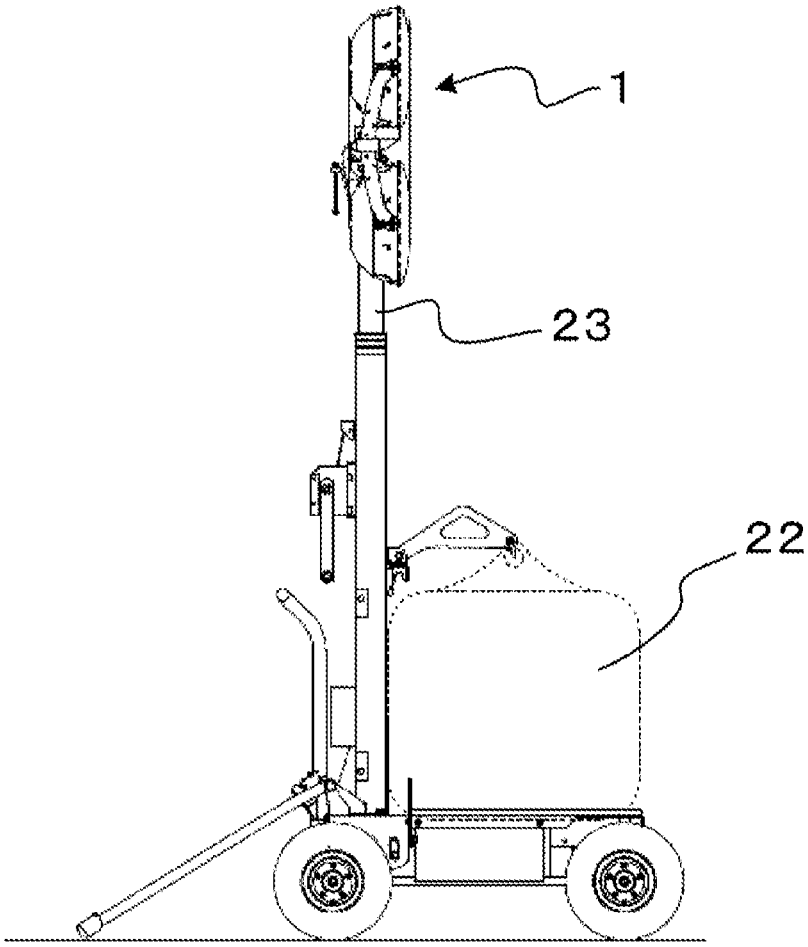
FIG. 7 is an explanatory view illustrating a state where a telescopic post of the LED floodlight device of FIG. 6 of the present invention is contracted.

An LED floodlight 1 includes a panel-shaped floodlight portion 2 formed as a large number of LEDs L is arranged on a substrate to form a floodlight surface, and a heatsink 3 is closely attached to a back surface side of the floodlight surface. As also illustrated in FIG. 3, the floodlight surface of the LED floodlight 1 is closed with a transparent cover 2*a* including a fixation groove 17 to which the periphery of a first cover member 12 to be described later is fit and fixedly secured.

In addition, a cover fixation groove 17 of the transparent cover 2*a* includes, on the inner circumferential side, an O-ring fixation groove 18 for retaining an O-ring 2*b* made of resin or rubber. Being closed by the transparent cover 2*a*, the floodlight surface of the panel-shaped floodlight portion 2 forms a closed chamber. It is preferable that thermoplastic material, e.g., polycarbonate, be selected as the material of the transparent cover 2*a* in consideration of safety and weatherability.

Furthermore, the panel-shaped floodlight portion 2 includes an air adjustment tube 10 extending through the heatsink 3 from the floodlight surface and a water shut-off valve 11 for preventing water entry. Therefore, the chamber of the panel-shaped floodlight portion 2 on the floodlight surface side is structured to relax a pressure relative to the ambient air and prevent water entry. Regarding the material of the water shut-off valve, a valve, for example, of GORE-TEX (registered trademark of W. L. Gore & Associates, Inc.), is desirable.

A power supply circuit 5 for supplying electric power to the panel-shaped floodlight portion 2 is mounted on a plate-shaped member and is configured to be a power supply plate 6. Furthermore, the power supply plate 6 includes an air passage hole 16 for a cooling fan 4 at a central portion and is interposed and fixed by screws B1 between the heatsink 3 and the first cover member 12.

The heatsink 3 is provided with the first cover member 12, and furthermore the first cover member 12 includes an air intake hole 15 for the cooling fan 4 at a central portion so that the cooling fan 4 is mounted by screws B2. The air intake hole 15 is a hole having a rectangular shape to fit to the shape of the cooling fan 4.

As the cooling fan 4, a water-proof one is selected, and the cooling fan 4 and a fan filter 4*b* are fixed by screws B3 via a spacer 4*a*. In addition, further outside of the cooling fan 4, a second cover 13 is fixed by screws B4 to the first cover member 12 such that the second cover 13 is lifted by a spacer 14.

Figure 1:
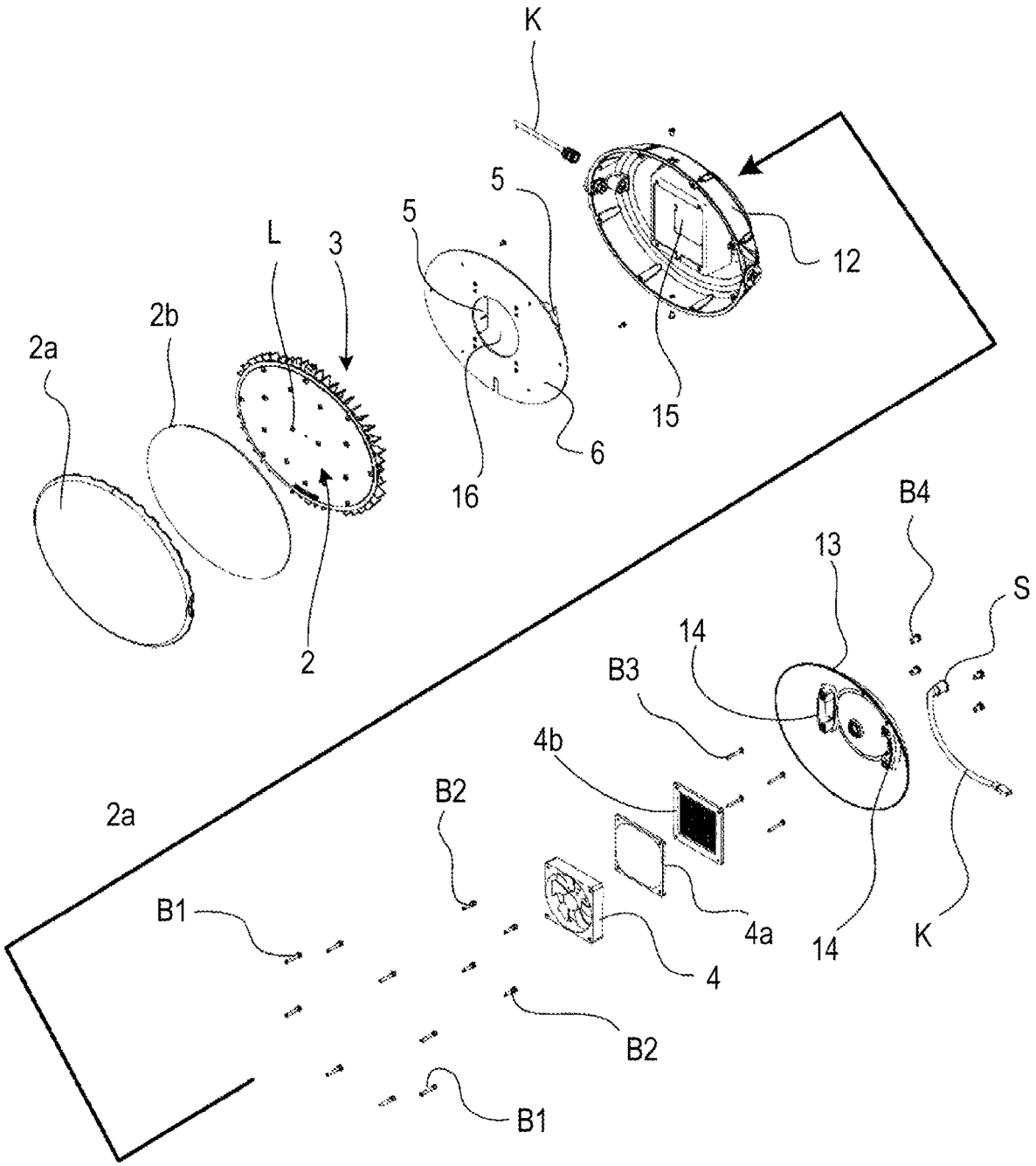
FIG. 1 is an explanatory perspective assembly view illustrating an LED floodlight indicating an optimal example of the present invention.
Figure 2:
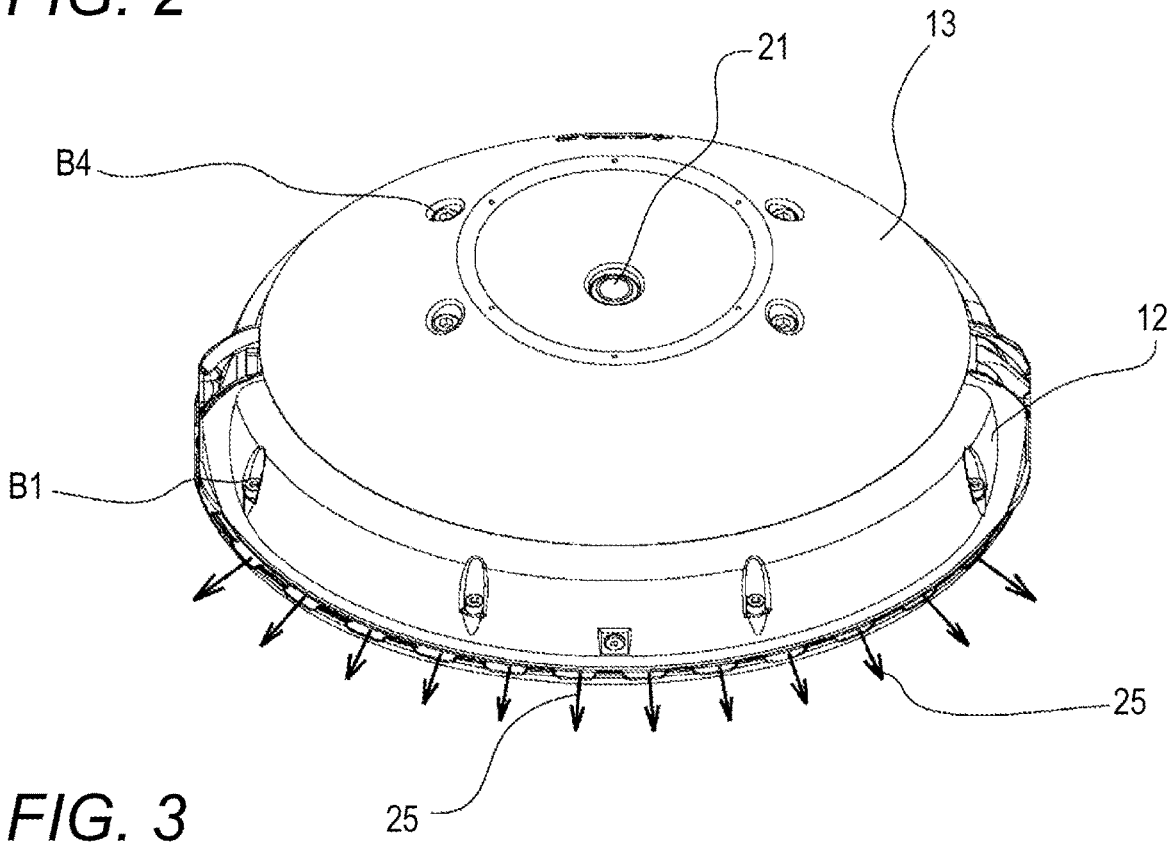
FIG. 2 is an explanatory perspective view viewed from a back surface side of a floodlight surface of the LED floodlight of the present invention.

Thus, the cooling air sucked by the cooling fan is sucked through the periphery of the second cover 13, passes through the first cover member 12, the air intake hole 15, and the air passage hole 16, and is supplied to the heatsink 3. In particular, the second cover 13 and the flow of the cooling air are indicated by arrows 25 of FIGS. 2 and 3. Specifically, because of the second cover 13, the first cover 12, and furthermore the power supply plate, the cooling air guided from the periphery of the second cover 13 is collected into the LED floodlight without leakage, and is blown to a central portion of the heatsink 3. The cooling air smoothly flows to the periphery of the heatsink 3 because of a portion protruding at a central portion of the heatsink 3 (on the side of the cooling fan 4) and thus forming a curved surface portion 9, so that the panel-shaped floodlight portion 2 can be cooled efficiently. In addition, as the material of the first cover member 12 and the second cover 13, a material that can be reduced in weight by magnesium alloy is desirable.

Regarding power supply, an external power supply is inserted into an external socket provided on the first cover member 12 via an appropriate power supply cable. In addition, the external power supply is connected, via an appropriate power supply cable, to an internal socket, which is associated with the external socket, and the power supply circuit 5 that are provided inside the first cover member 12.

In addition, on the outer side of the second cover 13, an ON/OFF and light control switch 21 is provided in a protruding manner and is connected to the power supply circuit 5 by an appropriate power supply cord. In addition, the cooling fan 4 is also configured to be controlled by being connected via an appropriate power supply cord so as to be driven in association with the ON/OFF and light control switch 21. The power supply circuit of the present example is controlled to switch to a power-saving mode so as not to be out of order and to reduce the electric power in the case where the cooling fan 4 cannot be rotated for failure or any other reasons. Furthermore, the interior of the power supply circuit 5 is configured such that the generated heat temperature of the floodlight or the surrounding ambient temperature is monitored, and the heatsink 3 is cooled while the rotation rate of the fan motor is properly adjusted. This function is not necessarily provided in the power supply circuit 5, but an auxiliary circuit board may be provided separately.

In the aforementioned example, the power supply circuit 5 is water-proofed, and in the present example, the power supply circuit 5 is placed in the LED floodlight 1. However, it goes without saying that the power supply circuit 5 may be placed outside of the LED floodlight 1.

The LED floodlight configured in the aforementioned manner has good cooling efficiency and excellent weatherability in outdoor use, and can be configured to be compact. Therefore, a large capacity power LED floodlight can be provided, which is industrially extremely beneficial.

REFERENCE SIGNS LIST

1 LED floodlight
2 panel-shaped floodlight portion
2*a* transparent cover
2*b* O-ring
3 heatsink
4 cooling fan
4*a* fan spacer
4*b* fan filter
5 power supply circuit
6 power supply plate
7 heat dissipation plate
8 coupling portion
9 curved surface portion
10 air adjustment tube
11 water shut-off valve
12 first cover member
13 second cover member
14 spacer
15 air intake hole
16 air passage hole
17 cover fixation groove
18 O-ring fixation groove
21 ON/OFF and light control switch
22 high-power battery device
23 telescopic post
25 air flow
B1 to B4 mounting screw
L LED

The invention claimed is:

1. An LED floodlight comprising:

a panel-shaped floodlight portion formed such that a plurality of LEDs is arranged on a front surface;

a heatsink having a plurality of heat dissipation plates on a back surface of the panel-shaped floodlight portion;

a cooling fan configured to send air, in this order;

a power supply circuit placed on a back surface side or outside of the panel-shaped floodlight portion; and a plate-shaped member interposed between the cooling fan and the heatsink, wherein the plate-shaped member has an air passage hole at a center and an annular plate-shaped part formed around the air passage hole, wherein the plurality of heat dissipation plates are positioned opposite to and face the annular plate-shaped part of the plate-shaped member to form an air flow path between the heatsink and the annular plate-shaped part of the plate-shaped member, wherein the plurality of heat dissipation plates are radially arranged from a central portion to a periphery of the heatsink, and a coupling portion between the heat dissipation plates has a curved surface portion protruding toward the cooling fan configured to send air, and wherein air sent by the cooling fan is sent toward the central portion of the heatsink through the air passage hole formed through the plate-shaped member, passes through the air flow path formed between the annular plate-shaped part of the plate-shaped member and the heatsink, and is discharged to the periphery of the heatsink.

2. The LED floodlight according to claim 1, wherein the panel-shaped floodlight portion includes an air adjustment tube extending through the heatsink from the floodlight surface, and wherein the air adjustment tube includes a water shut-off valve that prevents water entry.

3. The LED floodlight according to claim 1, wherein the heatsink includes a first cover member, the first cover member includes an air intake hole for the cooling fan at a center, and the first cover member is provided with a second cover member for covering a center of the first cover member at a distance that forms an air intake passage.

4. The LED floodlight according to claim 1, wherein the power supply circuit is mounted on a surface opposite to the panel-shaped floodlight portion of the plate-shaped member.

* * * * *